US008851280B2

(12) United States Patent
Wen

(10) Patent No.: US 8,851,280 B2
(45) Date of Patent: Oct. 7, 2014

(54) TABLET COVER

(76) Inventor: Feng Wen, Dongguan (CN)

( * ) Notice: Subject to any disclaimer, the term of this patent is extended or adjusted under 35 U.S.C. 154(b) by 289 days.

(21) Appl. No.: 13/478,028

(22) Filed: May 22, 2012

(65) Prior Publication Data

US 2013/0313142 A1 Nov. 28, 2013

(51) Int. Cl.
*B65D 85/00* (2006.01)

(52) U.S. Cl.
USPC ..... 206/320

(58) Field of Classification Search
USPC ..... 206/320, 701, 45.28; 220/23.91, 220/495.01; 16/226, 221; 150/154–168
See application file for complete search history.

(56) References Cited

U.S. PATENT DOCUMENTS 5,480,118 A * 1/1996 Cross ..... 248/459
6,008,983 A * 12/1999 Yen ..... 361/679.11
8,520,377 B2 * 8/2013 Senatori ..... 361/679.27
2003/0052856 A1 * 3/2003 Nakamura ..... 345/110
2004/0114315 A1 * 6/2004 Anlauff ..... 361/681
2011/0297566 A1 * 12/2011 Gallagher et al. ..... 206/320
2012/0043234 A1 * 2/2012 Westrup ..... 206/320
2013/0015088 A1 * 1/2013 Wu ..... 206/320
2013/0016467 A1 * 1/2013 Ku ..... 361/679.08
2013/0020215 A1 * 1/2013 Hsu ..... 206/320

* cited by examiner

*Primary Examiner* — Luan K Bui
*Assistant Examiner* — Rafael Ortiz
(74) *Attorney, Agent, or Firm* — Clement Cheng

(57) ABSTRACT

A tablet cover comprising a top cover having a top cover hinge mounted on a side edge of the top cover; a bottom cover having a bottom cover hinge mounted on an outside surface of the bottom cover; and an extension arm swivel connected to the bottom cover at the bottom cover hinge. The length of the extension arm is approximately half of a width of the tablet cover. The intermediate hinge arm is swivel connected to the extension arm at an intermediate hinge and the intermediate hinge arm is swivel connected to the top cover at the top cover hinge. A length of the intermediate hinge arm is approximately a thickness of the tablet cover. The tablet cover has an open position, a stand position and a closed position.

1 Claim, 7 Drawing Sheets

TABLET COVER

FIELD OF THE INVENTION

The present invention is in the field of tablet covers.

DISCUSSION OF RELATED ART

With increased popularity in the tablet computing platform, a variety of tablet covers have been devised for protecting mobile tablet computers. Some of the tablet covers introduce style and ornamentation to an otherwise plain tablet housing.

SUMMARY OF THE INVENTION

A tablet cover comprising a top cover having a top cover hinge mounted on a side edge of the top cover; a bottom cover having a bottom cover hinge mounted on an outside surface of the bottom cover; and an extension arm swivel connected to the bottom cover at the bottom cover hinge. The length of the extension arm is approximately half of a width of the tablet cover. The intermediate hinge arm is swivel connected to the extension arm at an intermediate hinge and the intermediate hinge arm is swivel connected to the top cover at the top cover hinge. A length of the intermediate hinge arm is approximately a thickness of the tablet cover. The tablet cover has an open position, a stand position and a closed position.

The tablet cover optionally includes an elongated bumper located on an outside bottom surface of the bottom cover. The elongated bumper rests on an inside surface of the top cover. A camera opening is formed on the bottom cover. A tab groove is formed on the bottom cover, and the tab groove receives a latch tab formed on the top cover when the tablet cover is in closed position.

A low angle tab groove is formed behind the intermediate hinge arm. The low angle tab groove is formed on the bottom cover. The low angle tab groove receives a latch tab formed on the top cover when the tablet cover is in a low angle stand position. A felt layer is laminated to an inside surface of the top cover. Top cover stops are formed on an inside surface of the top cover, and the top cover stops are positioned to engage elongated bumpers located on an outside bottom surface of the bottom cover.

A first elongated bumper is located on an outside bottom surface of the bottom cover, and the first elongated bumper rests on an inside surface of the top cover. A second elongated bumper is located on the outside bottom surface of the bottom cover. The second elongated bumper rests on an inside surface of the top cover. The intermediate hinge arm is mounted between the first elongated bumper and the second elongated bumper.

Figure 1:
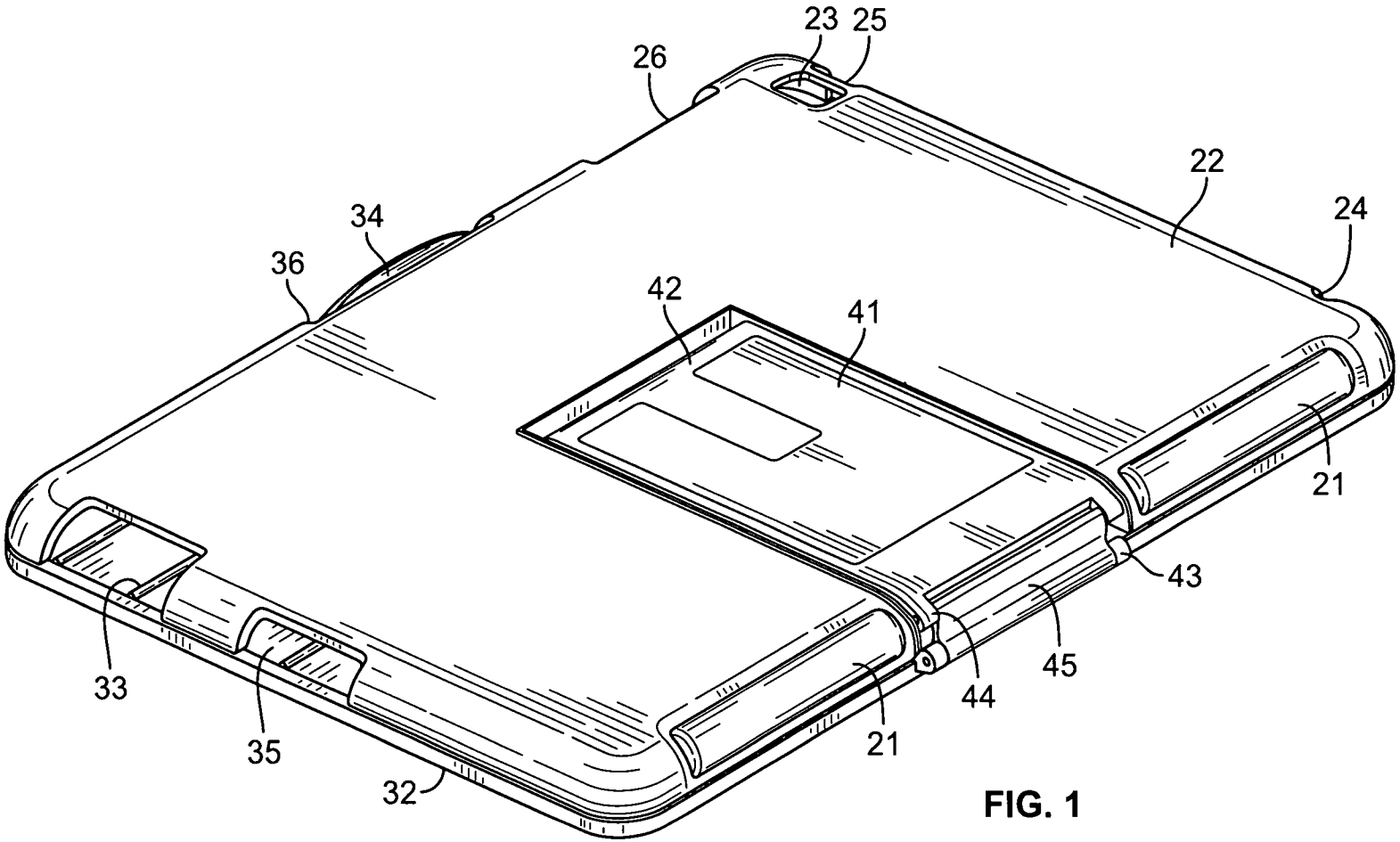
FIG. 1 is a bottom perspective view of the tablet cover.
Figure 2:
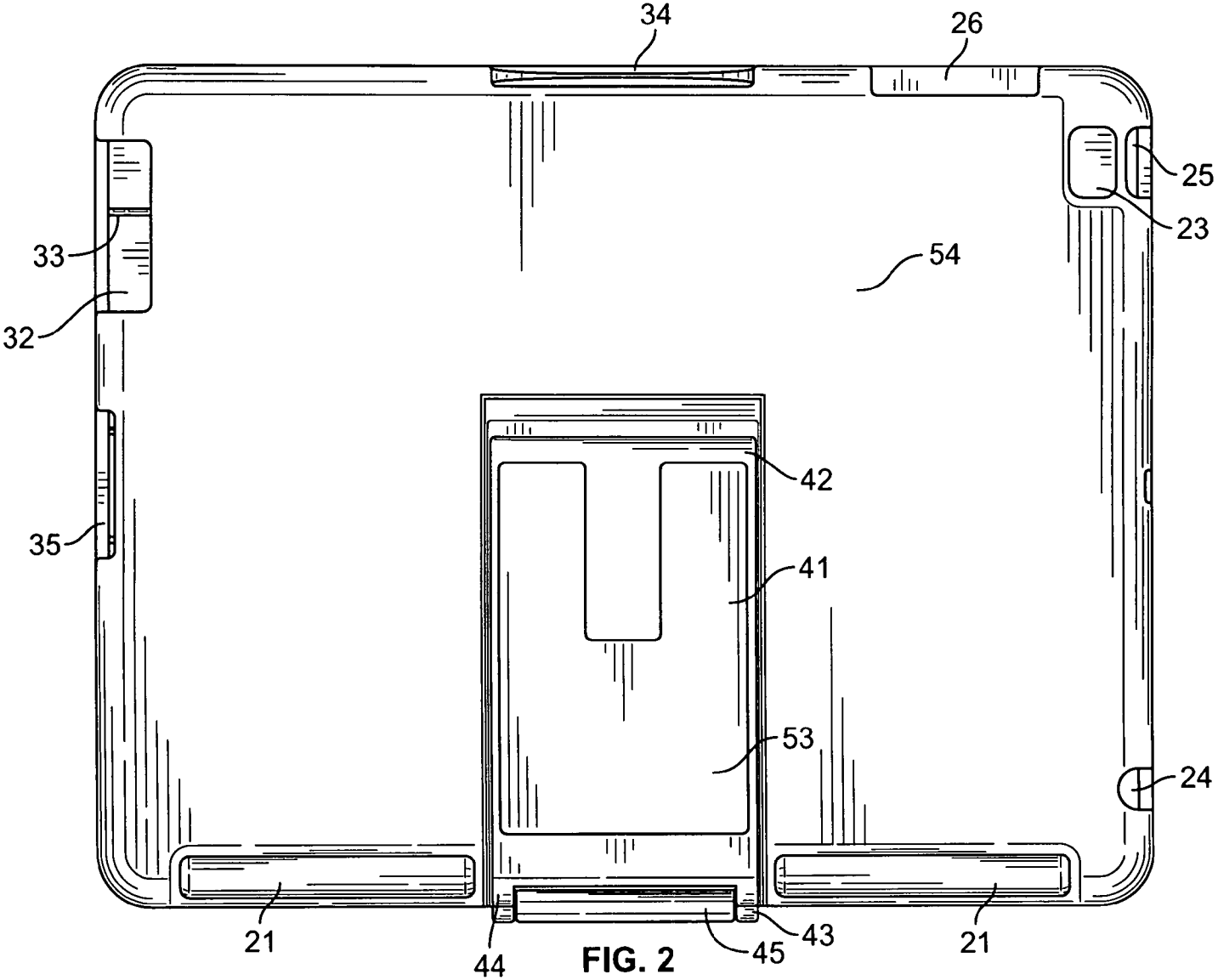
FIG. 2 is a bottom view of the tablet cover in closed position.
Figure 3:
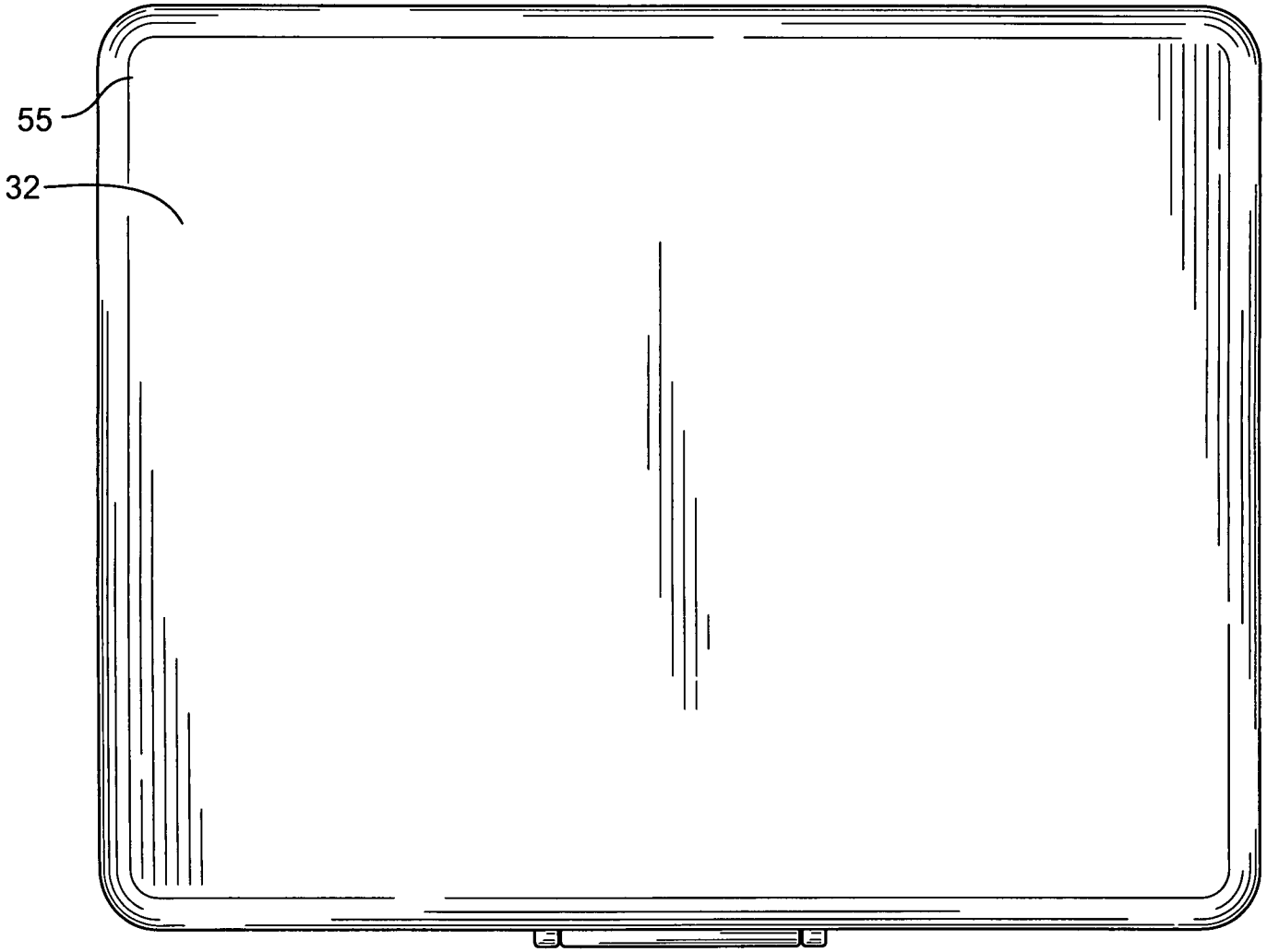
FIG. 3 is a top view of the tablet cover in closed position.
Figure 6:
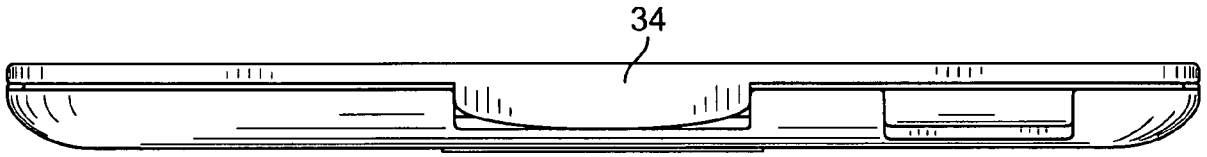
FIG. 6 is a front view of the tablet cover in closed position.
Figure 7:
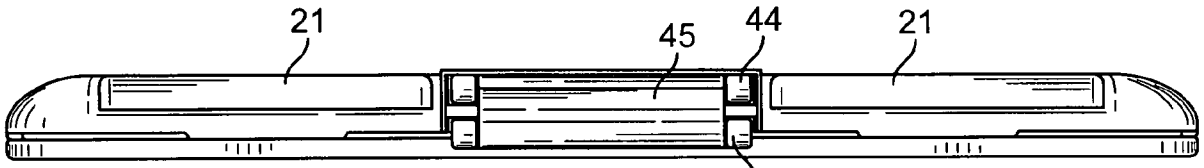
FIG. 7 is a rear view of the tablet cover in closed position.
Figure 5:
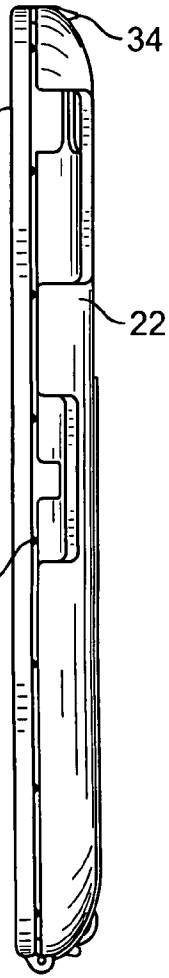
FIG. 5 is a left side view of the tablet cover in closed position.
Figure 4:
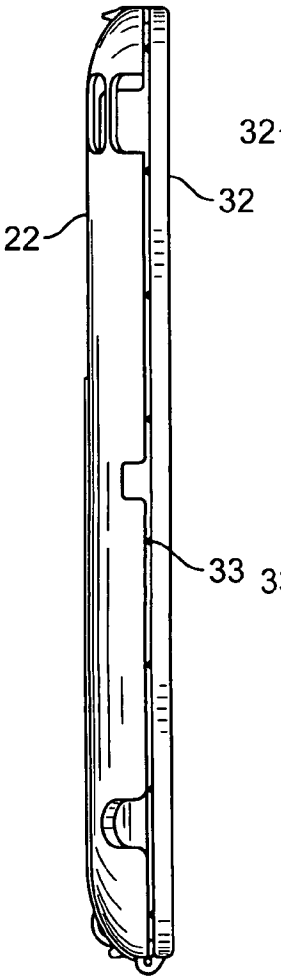
FIG. 4 is a right side view of the tablet cover in closed position.
Figure 8:
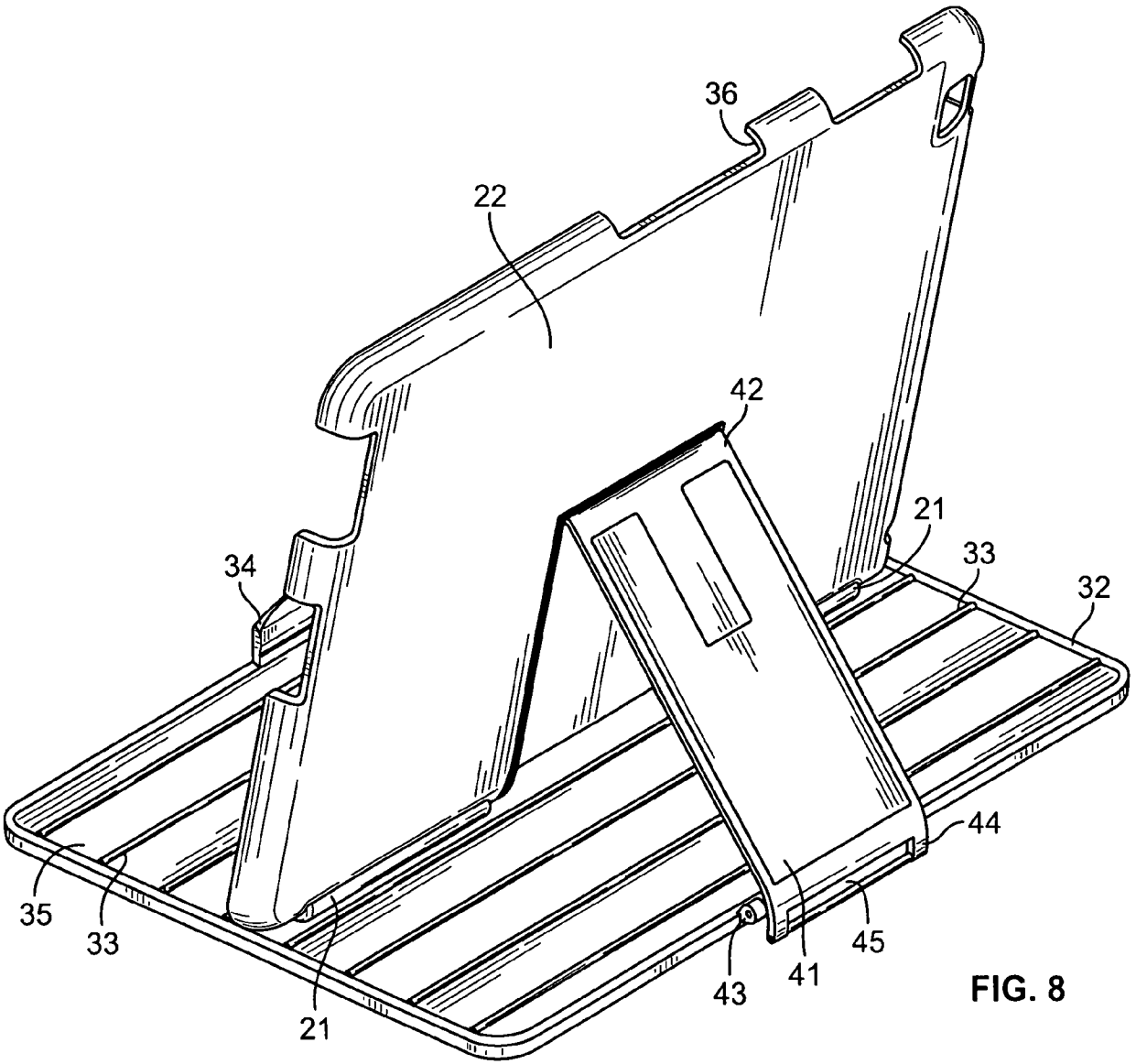
FIG. 8 is a perspective view of the tablet cover in deployed position.

The following callout list of elements can be a useful guide in referencing the elements of the drawings.

21 Bumper
22 Bottom Cover
23 Camera Opening
24 Auxiliary Side Opening
25 Power Button Opening
26 Volume Control Opening
32 Top Cover
33 Top Cover Stop
34 Latch Tab
35 Felt Layer
36 Tab Groove
37 Low Angle Tab Groove
41 Extension Arm
42 Bottom Cover Hinge
43 Top Cover Hinge
44 Intermediate Hinge
45 Intermediate Hinge Arm
51 Inside Bottom Cover Overlay Layer
52 Inside Top Cover Overlay Layer
53 Extension Arm Overlay Layer
54 Outside Bottom Cover Overlay Layer
55 Outside Top Cover Overlay Layer

DETAILED DESCRIPTION OF THE PREFERRED EMBODIMENT

The present invention is a tablet cover for a tablet computer. The tablet computer is electronic and has a microprocessor and a screen. The housing for the tablet computer is held within the tablet cover. The tablet cover has a bottom cover 22 and a top cover 32. The bottom cover is connected to the top cover by an extension arm 41. The extension arm 41 allows the top cover to swivel relative to the bottom cover. It is preferred that the bottom cover and top cover are both made of polycarbonate plastic. The bottom cover and the top cover preferably have an indentation to receive a surface decorative layer which can be made of any soft material such as polyurethane or polypropylene plastic sheet. The tablet cover bottom cover and top cover are both rigid members preferably made of opaque polycarbonate.

The bottom cover 22 may have a bottom cover overlay layer 51 that can be formed of a plastic sheet that has adhesive lamination to an indented area formed on an inside surface of the bottom cover. The top cover 32 can have a top cover overlay layer 52 that can be formed of a plastic sheet that has adhesive lamination to an indented area of an inside surface of the top cover. The extension arm 41 may have an extension arm overlay layer 53 that has adhesive lamination to an indented area formed on and exterior surface of the extension arm. The extension arm 41 is preferably made of aluminum or metal. The bottom cover also preferably has an outside bottom cover overlay layer 54 that has adhesive lamination to an indented area formed on an outside surface of the bottom cover 22. The top cover 32 preferably has an outside top cover overlay layer 55 that can have an adhesive lamination to an indented area formed on an outside surface of the top cover 32.

The bottom cover 22 has a pair of bumpers 21 are preferably formed as elongated rounded protrusions extending from the bottom side corner of the bottom cover. Each bumper 21 is preferably made of a rubberized grippy material unlike the hard plastic material of the bottom cover. The bumpers are molded in place to the bottom cover 22. The bottom cover 22 may also have a camera opening 23 on a flat portion of the bottom cover 22. Other openings such as an auxiliary side opening 24 may allow for additional user controls, or communications such as wireless or infrared communications. Other side openings such as a power button opening 25 can be disposed on a side of the bottom cover 22. The bottom cover 22 may also have a volume control opening 26 that is formed on a side wall of the bottom cover and allows a user to adjust volume on a rocker switch of the tablet computer.

A latch tab 34 extending from a top cover 32 fits with a tab groove 36 formed on the bottom cover 22. The latch tab 34 may grip a portion of the tablet computer, or can be left free. The latch tab 34 extends at a right angle to the surface of the top cover 32.

The top cover 32 also includes a felt layer 35 over rows of top cover stops 33. The top cover stops can be formed from elastomeric material in a second mold injection so that the top cover stops are molded into the inside surface of the top cover. Alternatively, the top cover stops can be formed on a felt layer 35 that is adhesively laminated to the inside surface of the top cover 32. The felt layer 35 can be coated with a sheet contact adhesive and laminated to an inside surface of the top cover 32. The top cover stops 33 are preferably formed as parallel rows of protrusions such as ridges. The ridges of the top cover stops 33 can be used to limit movement of a bumper 21 on the felt layer 35. The bumper 21 can also be placed at an intermediate distance between top cover stops 33.

The extension arm 41 connects between the bottom cover hinge 42 and the top cover hinge 43. The bottom cover hinge 42 is connected to the bottom surface of the bottom cover 22. The bottom cover hinge 42 is mounted so as to swivel the bottom cover 22 relative to the extension arm 41. The top cover hinge 43 optionally includes an intermediate hinge arm 45 and intermediate hinge 44. The intermediate hinge 44 is a swivel connection between the extension arm 41 and the intermediate hinge arm 45. The intermediate hinge arm 45 swivels relative to the top cover via the top cover hinge 43. The extension arm and intermediate hinge arm are rigid members.

The intermediate hinge arm 45 provides a second section and an additional degree of freedom. The extension arm is a first section and the intermediate hinge arm is a second section that connects the bottom cover hinge to the top cover hinge. Although more than one intermediate hinge arm and extension arm 41 can be used, such as by having a pair of extension arms, it is preferred to have a single large extension arm located in the middle of the bottom cover 22. It is preferred that the length of the intermediate hinge arm 45 is approximately the thickness of the tablet cover. It is preferred that the length of the extension arm 41 is approximately slightly more than half the length of the tablet cover.

This construction allows the tablet cover to swivel from a stowed position which is closed to a deployed position which is open. The top cover can be folded back so that the outside surface of the bottom cover is facing the outside surface of the top cover. The top cover can also be opened and used as a base. When the top cover is a base, the outside surface of the top cover rests on the table and the inside surface of the top cover is exposed to the bumpers 21 that are formed on the bottom cover. An edge of the bottom cover that has bumpers is the bottom cover bumper edge. The bottom cover bumper edge rests on the inside surface of the top cover.

The tablet cover becomes a stand when the extension arm 41 is used to prop up the bottom cover on the top cover. The stand is adjustable from a low angle position to a high angle position.

Intermediate positions are also available. The top cover stops 33 are preferably formed as elongated ridges extending across the inside surface of the top cover. The top cover stops 33 provide more grip if necessary to prevent the tablet from sliding between the low angle position or the high angle position should a user be using the tablet cover stand on a lap for example.

Figure 9:
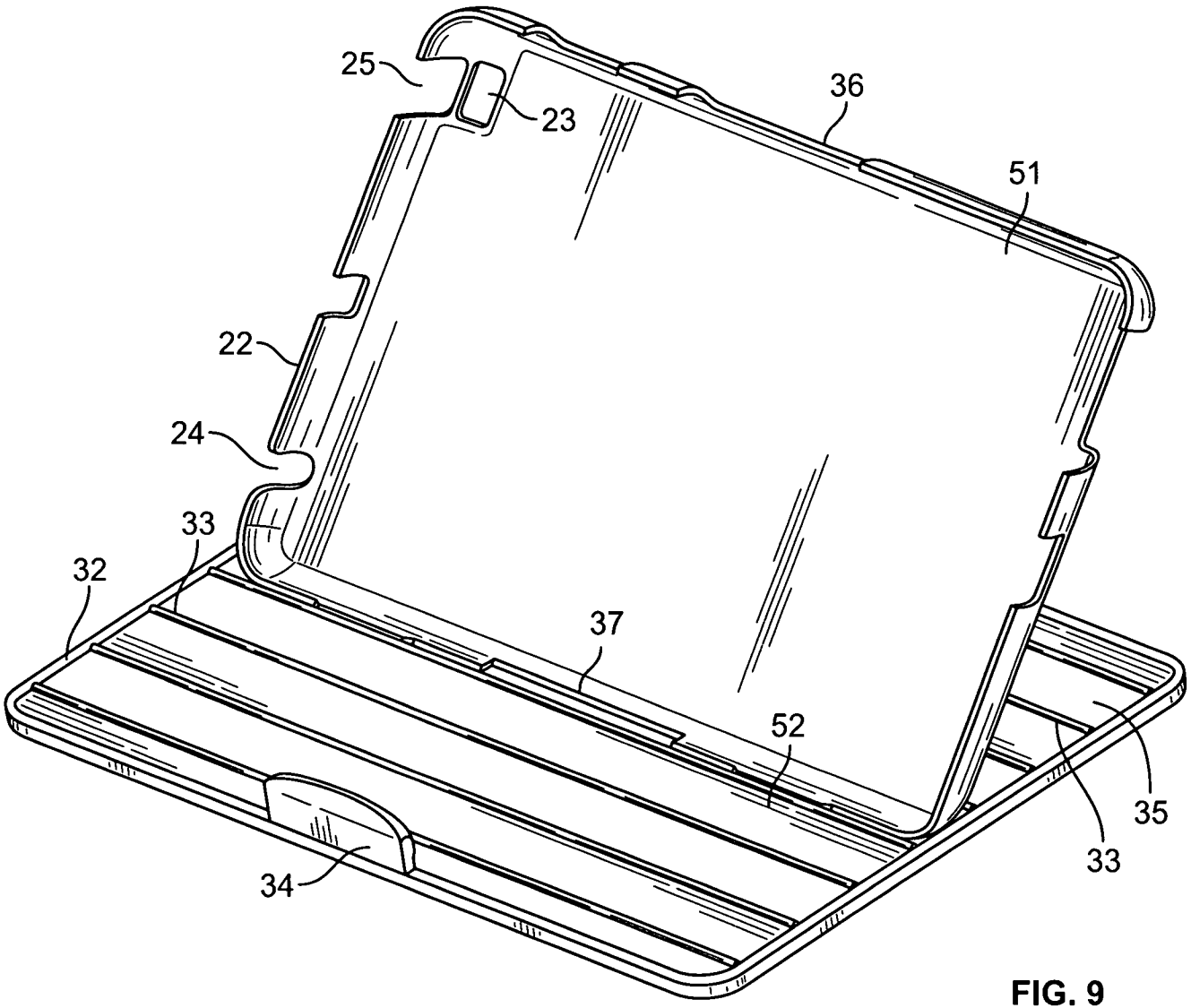
FIG. 9 is a perspective view of the tablet cover in deployed position.
Figure 12:
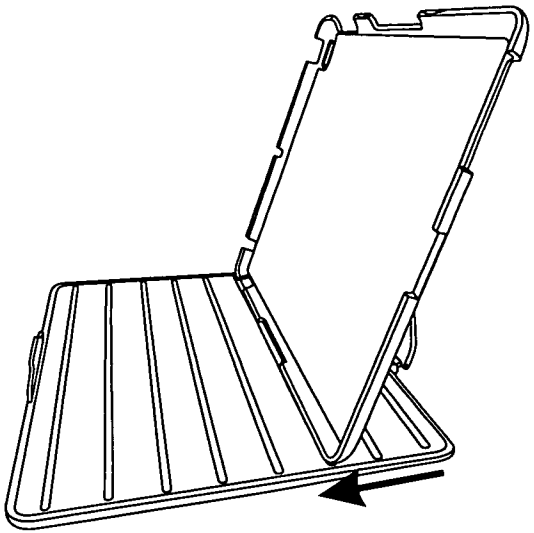
FIG. 12 is a diagram of the tablet cover in a high angle position.
Figure 11:
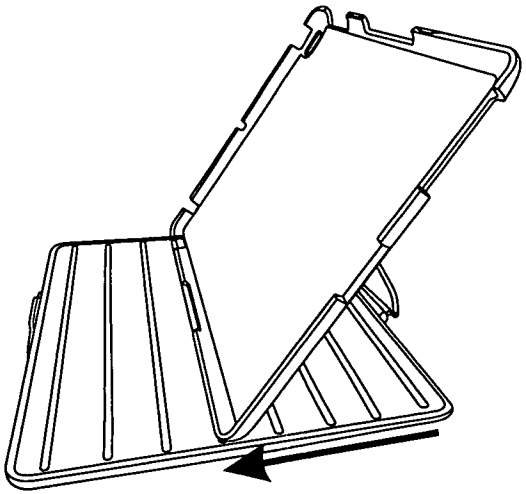
FIG. 11 is a diagram of the tablet cover in a medium angle position.
Figure 10:
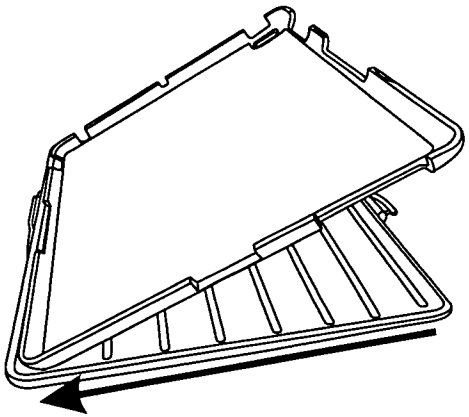
FIG. 10 is a diagram of the tablet cover in a low angle position.

The tab groove 36 is opposed by a low angle tab groove 37 that is formed near the intermediate hinge arm 45 and covered by it when in closed position. The low angle tab groove 37 receives the top latch tab 34 when the tablet cover is in a lowest angle stand position as seen in FIG. 9. The tab groove 36 receives the top latch tab 34 when the tablet cover is in closed position.

While the presently preferred form of the system has been shown and described, and several modifications thereof discussed, persons skilled in this art will readily appreciate that various additional changes and modifications may be made without departing from the spirit of the invention, as defined and differentiated by the following claims.

The invention claimed is:

1. A tablet cover comprising:

a. a top cover having a top cover hinge mounted on a side edge of the top cover;

b. a bottom cover having a bottom cover hinge mounted on an outside surface of the bottom cover;

c. an extension arm, wherein the extension arm is swivel connected to the bottom cover at the bottom cover hinge, wherein the length of the extension arm is approximately half of a width of the tablet cover;

d. an intermediate hinge arm, wherein the intermediate hinge arm is swivel connected to the extension arm at an intermediate hinge and wherein the intermediate hinge arm is swivel connected to the top cover at the top cover hinge, wherein a length of the intermediate hinge arm is approximately a thickness of the tablet cover, wherein the tablet cover has an open position, a stand position and a closed position;

e. a first elongated bumper located on an outside bottom surface of the bottom cover, wherein the first elongated bumper rests on an inside surface of the top cover; and a second elongated bumper located on the outside bottom surface of the bottom cover, wherein the second elongated bumper rests on an inside surface of the top cover, wherein the intermediate hinge arm is mounted between the first elongated bumper and the second elongated bumper;

f. a camera opening formed on the bottom cover;

g. a tab groove formed on the bottom cover, wherein the tab groove receives a latch tab formed on the top cover when the tablet cover is in closed position;

h. a low angle tab groove formed behind the intermediate hinge arm, wherein the low angle tab groove is formed on the bottom cover, wherein the low angle tab groove receives a latch tab formed on the top cover when the tablet cover is in a low angle stand position;

i. a felt layer laminated to an inside surface of the top cover;

j. top cover stops formed on an inside surface of the top cover, wherein the top cover stops are positioned to engage elongated bumpers located on an outside bottom surface of the bottom cover.

* * * * *